US006382223B1

(12) United States Patent
Lah

(10) Patent No.: US 6,382,223 B1
(45) Date of Patent: May 7, 2002

(54) FEATHERLITE TENT POLE

(76) Inventor: Jeh-kun Lah, 542-3, Gajwa-Dong, Suh-Gu, Inchon, 404-250 (KR)

( * ) Notice: Subject to any disclaimer, the term of this patent is extended or adjusted under 35 U.S.C. 154(b) by 0 days.

(21) Appl. No.: 09/723,072

(22) Filed: Nov. 27, 2000

(51) Int. Cl.[7] ..... E04H 15/34; E04H 15/60

(52) U.S. Cl. ..... 135/114; 52/726.3; 403/11; 135/909

(58) Field of Search ..... 135/114, 909; 52/726.1, 726.2, 726.3; 403/294, 347, 360, 361, 377, 11

(56) References Cited

U.S. PATENT DOCUMENTS 1,846,305 A * 2/1932 Brooks ..... 135/144 X 3,447,549 A * 6/1969 Cunningham ..... 135/114

FOREIGN PATENT DOCUMENTS

DE 695534 * 8/1940 ..... 52/726.3

* cited by examiner

*Primary Examiner*—Robert Canfield
(74) *Attorney, Agent, or Firm*—Schweitzer Cornman Gross & Bondell LLP

(57) ABSTRACT

A tent pole assembly and a connecting structure thereof include a reduced tube part of a prescribed length formed at an end, the reduced tube part being inserted into a tent pole section, and a reinforced rod disposed inside a start part of the reduced tube part to reinforce the start part, the reinforced rod having the external shape corresponding to the internal shape of the start part.

8 Claims, 8 Drawing Sheets

FEATHERLITE TENT POLE

BACKGROUND OF THE INVENTION

1. Field of the Invention

The present invention relates to a featherlite tent pole and a connecting structure thereof, and more particularly, to a featherlite tent pole and a connecting structure thereof, which can overcome weakness of connected portions between tent poles, which form a framework of a tent, and maintain a securely connected state of the tent pole.

2. Description of the Related Art

In general, a tent includes a waterproof cloth and a plurality of tent poles to make a temporary dwelling for camping or spending time outdoors. The plural tent poles are assembled to each other to form a prescribed shape which is covered with the waterproof cloth to form the tent.

The tent poles are a framework for forming the inside space of the tent, and are manufactured in the form of a cylindrical pipe. As is known, the interior space of each tent pole can be provided with an elastic rubber band or an elastic cord. The plural tent poles are simply connected to each other by using the elasticity of the elastic cords, and the elastic cords are fixed by locking tips mounted at the end portion of the tent pole.

FIG. 1 is a sectional view of prior art conventional tent poles in a connected state. As shown in FIG. 1, in case of the conventional tent poles, a connection pipe 4 of a prescribed length is inserted inside two tent poles 2 and 6 to connect the tent poles 2 and 6 with each other. The external diameter of the connection pipe 4 is restricted by the internal diameter of the tent poles 2 and 6. Therefore, the strength of the connection pipe 4 and the connection made thereby is determined by the thickness and the quality of the material of the connection pipe 4.

If the tent poles 2 and 6 are connected by the connection pipe 4, there occurs a destruction phenomenon at the connected part of the tent poles 2 and 6 as follows. If the strength of the connection pipe 4 is less than that of the tent poles 2 and 6, as shown in FIG. 2, first the connection pipe 4 is bent by the external force. To the contrary, if the strength of the connection pipe 4 is greater than that of the tent poles 2 and 6, as shown in FIG. 3, first the tent poles 2 and 6 are bent.

Another well known connecting structure of the tent poles is shown in FIG. 4. A tent pole 8 has a reduced tube part 10 formed at an end thereof. The external diameter of the reduced tube part 10 is smaller than the internal diameter of other portions of the tent pole 8. The reduced tube part 10 is inserted into an end portion of another tent pole 12, and thereby the tent poles 8 and 12 are connected to each other. Such connecting structure has a reduced weight in comparison with the connecting structure using the connection pipe.

However, since the external diameter of the reduced tube part 10 must be smaller than or equal to the internal diameter of the tent pole 12, the thickness of the reduced tube part 10 is constant and is restricted in change. Therefore, since the thickness of the reduced tube part 10 is restricted in increase but a start part 11 of the reduced tube part 10 has a smaller product of inertia than other portions, the stress caused by an external force is concentrated on the start part 11 of the reduced tube part 10. Therefore, there occurs a phenomenon that the start part 11 of the reduced tube part 10 is the first area to fail, as shown in FIG. 5.

SUMMARY OF THE INVENTION

It is, therefore, an object of the present invention to provide a featherlite tent pole and a connecting structure thereof, which can prevent a start part of a reduced tube part from being damaged by the external force by reinforcing the start part of the reduced tube part.

To achieve the above object, the present invention provides a featherlite tent pole comprising: a reduced tube part of a prescribed length formed at an end, the reduced tube part being inserted into the tent pole; and a reinforced rod disposed inside a start part of the reduced tube part to reinforce the start part, the reinforced rod having the external form corresponding to the internal form of the start part.

It is preferable that the reinforced rod includes a round portion being in the form of a ring, which has an external diameter corresponding to the internal diameter of the reduced tube part, and a conical portion having a slanted surface. The slanted surface of the conical portion is sized and shaped to correspond to and contact the slanted internal diameter of the start part.

In the tent pole according to the present invention, it is preferable that an enlarged tube part is formed at the other end portion of the tent pole to insert the reduced tube part of another tent pole to be connected to the tent pole and a stopper is disposed inside the enlarged tube part to restrict the advance of the reduced tube part of the other tent pole. The stopper is in the form of a ring having a hole at the center.

Moreover, according to the method of the present invention, a connecting structure of tent poles is formed by mounting reinforcing rods inside a start part of a reduced tube part of a prescribed length formed at an end portion of a tent pole, each reinforcing rod having the external form corresponding to the internal form of the start part; and connecting the tent pole with another tent pole by inserting the reduced tube part into an end portion of the other tent pole to be connected.

DESCRIPTION OF THE DRAWINGS

Further objects and advantages of the invention can be more fully understood from the following detailed description m taken in conjunction with the accompanying drawings in which.

DETAILED DESCRIPTION OF THE PREFERRED EMBODIMENT

Figure 1:
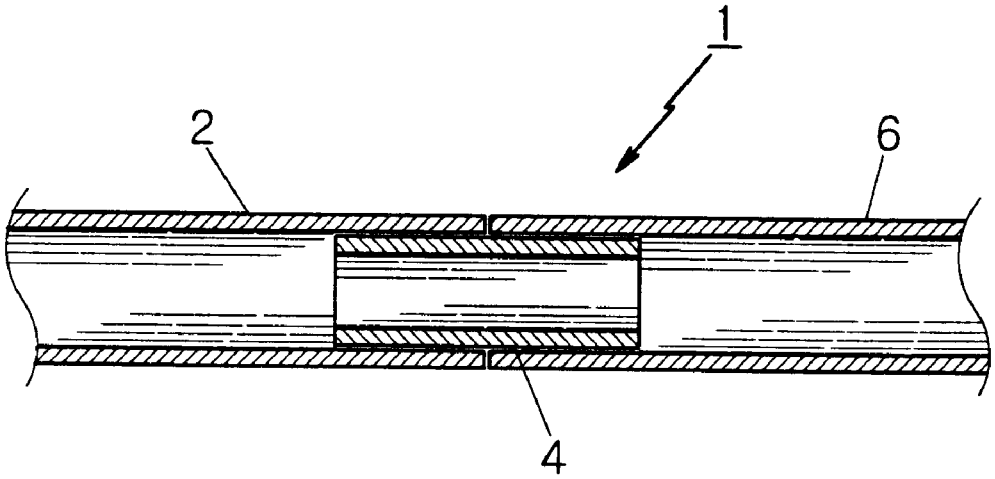
FIG. 1 is a partially enlarged sectional view showing a connected state of a conventional tent pole.
Figure 2:
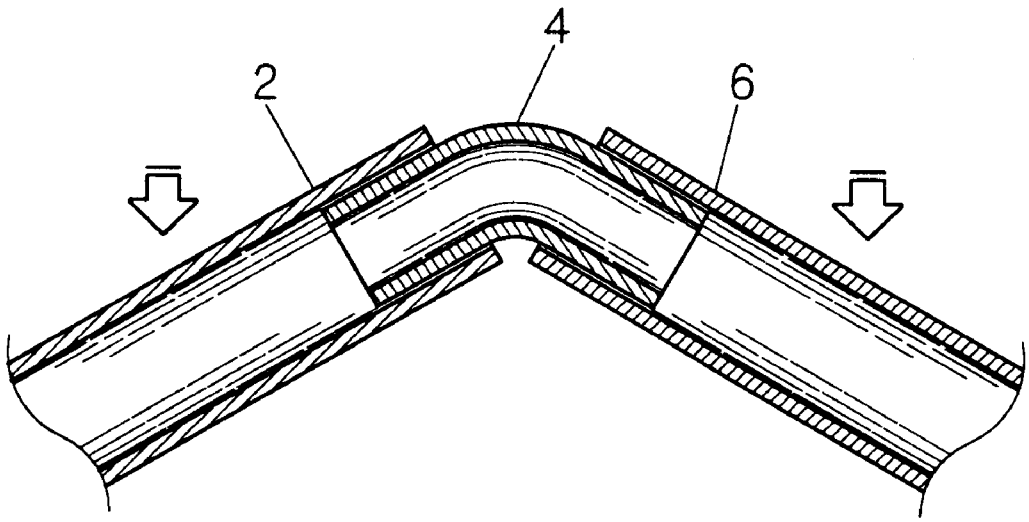
FIG. 2 is a sectional view showing a damaged state of a tent pole, when the strength of a connection rod inside the tent pole of FIG. 1 is lesser than that of the tent pole.
Figure 3:
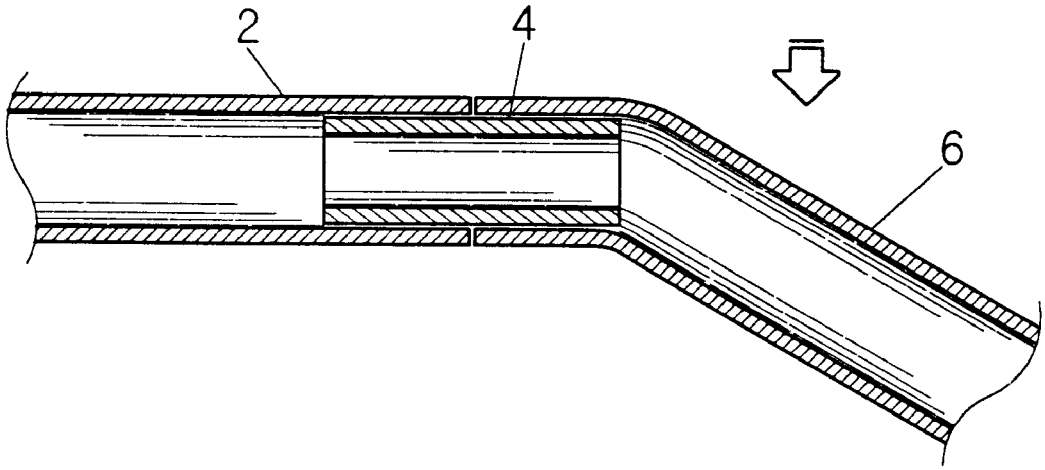
FIG. 3 is a sectional view showing a damaged state of the tent pole, when the strength of the connection rod inside the tent pole of FIG. 1 is greater than that of the tent pole.
Figure 4:
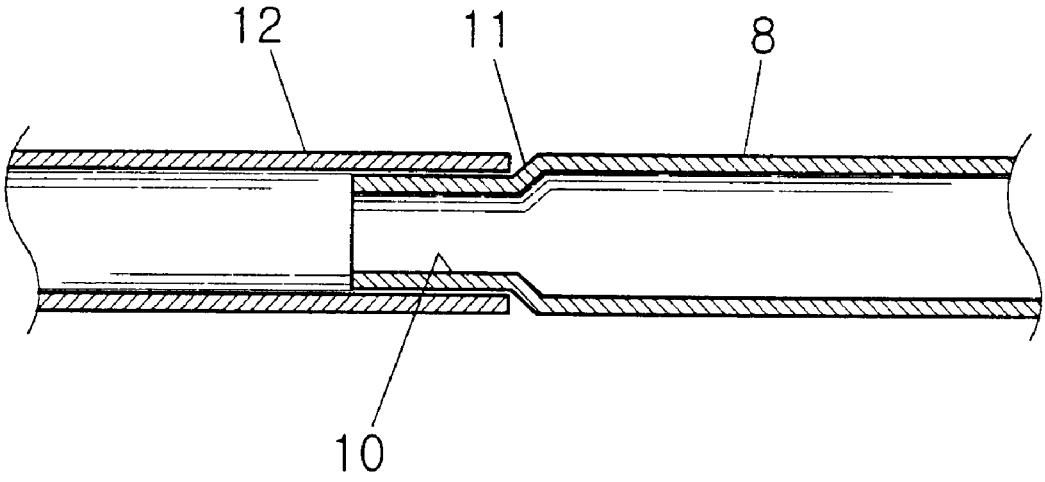
FIG. 4 is a sectional view showing another preferred embodiment of the conventional tent pole connecting structure.
Figure 5:
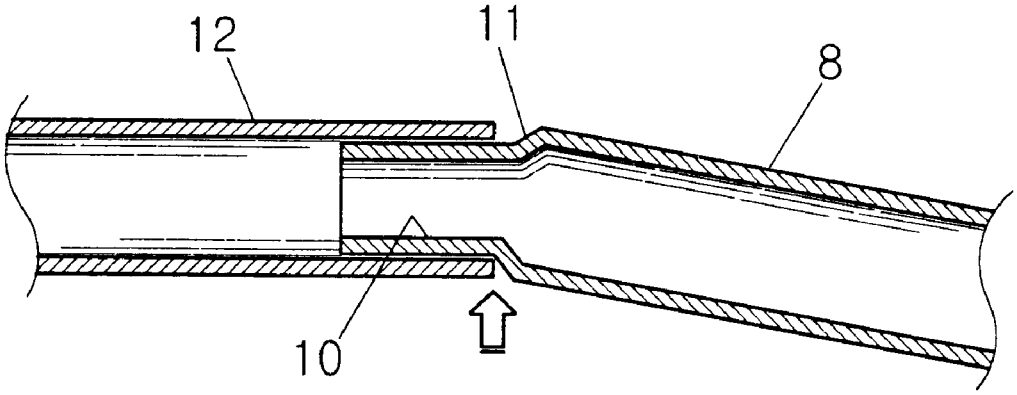
FIG. 5 is a sectional view showing a damaged state of the tent pole of FIG. 4.

The present invention will now be described in detail in connection with preferred embodiments with reference to the accompanying drawings. For reference, like reference characters designate corresponding parts throughout several views.

Figure 6:
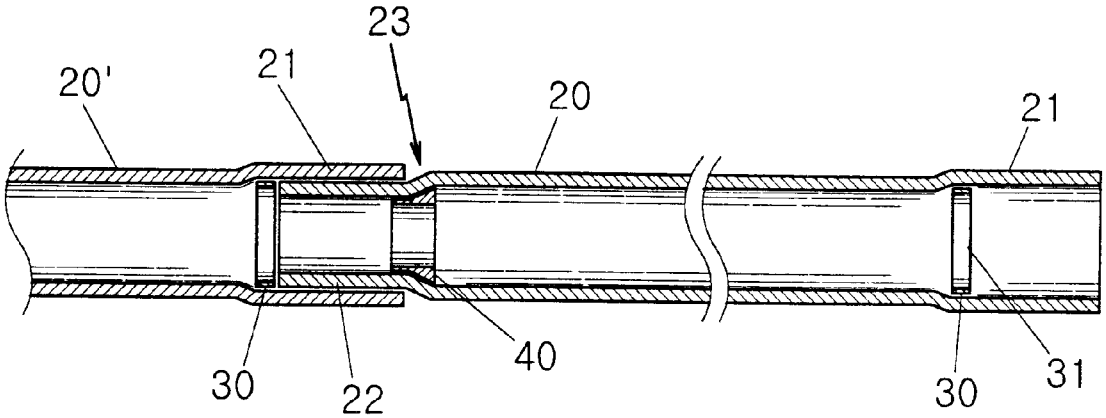
FIG. 6 is a sectional view showing a tent pole according to the present invention.
Figure 7:
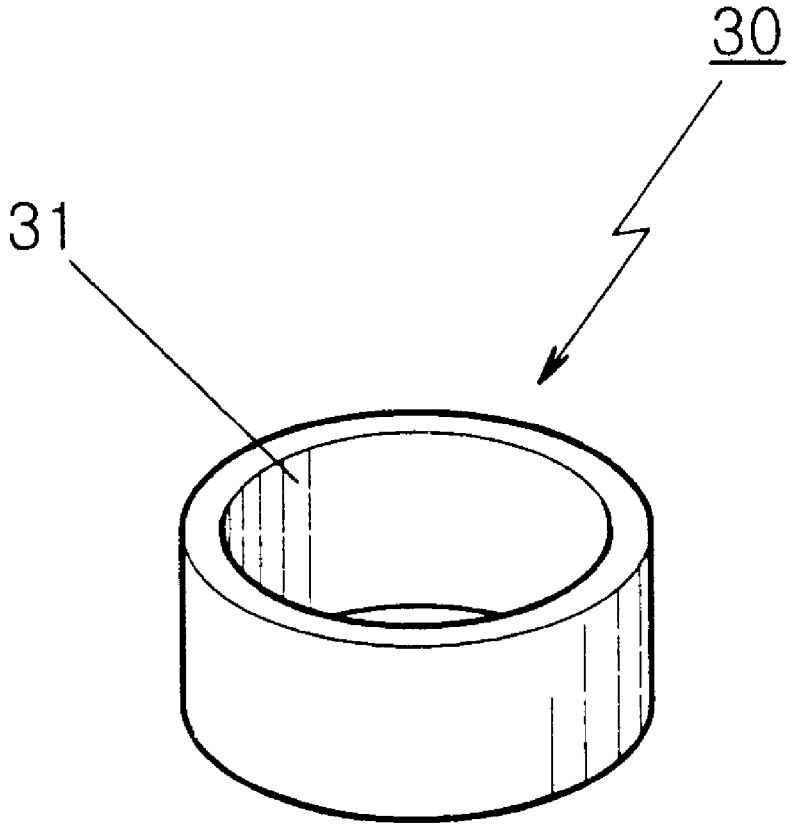
FIG. 7 is a perspective view of a stopper provided to the tent pole according to the present invention.
Figure 8:
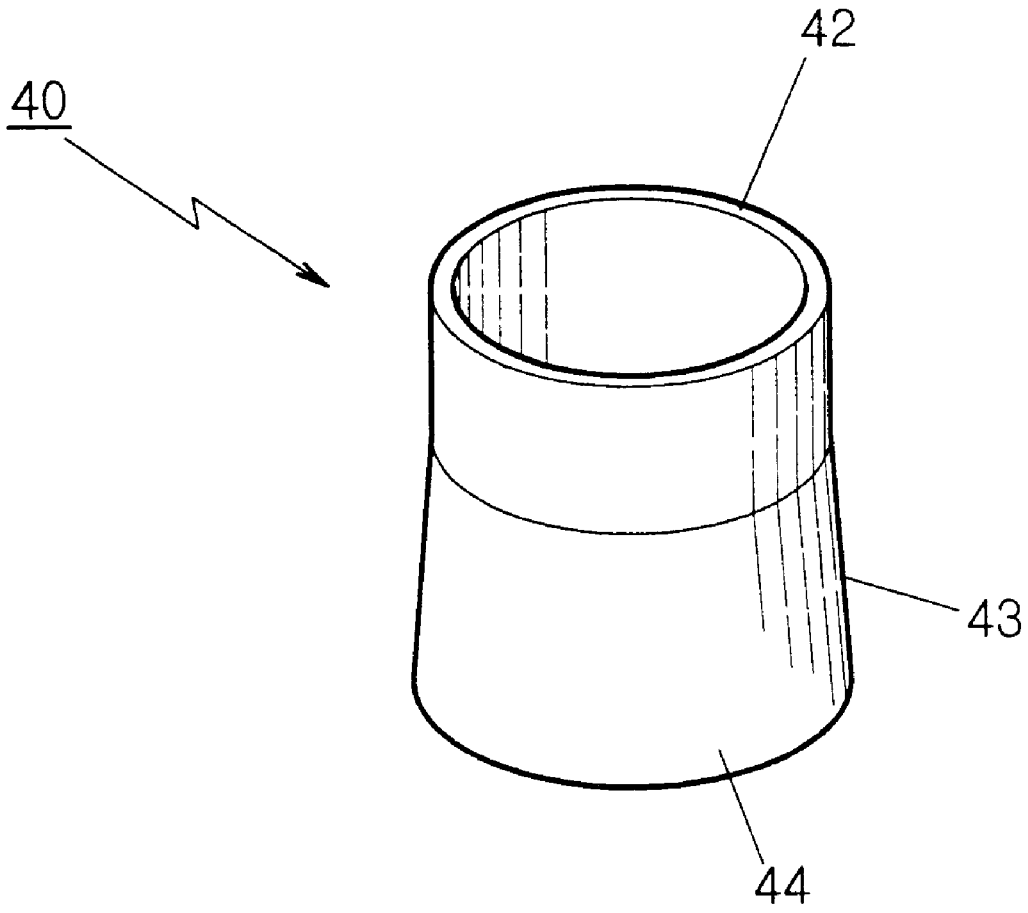
FIG. 8 is a perspective view of a reinforced rod provided to the tent pole according to the present invention.

FIG. 6 is a sectional view showing an assembled state of the present invention, FIG. 7 is a perspective view of a stopper designed for insertion into a tent pole and FIG. 8 is a perspective view of a reinforced rod designed for insertion into the tent pole of the present invention.

As shown in the drawings, a tent pole 20 according to the present invention has a reduced tube part 22 of a prescribed length formed at an end thereof, and the reduced tube part 22 has the external diameter smaller than that of other portions of the tent pole. The tent pole 20 has an enlarged tube part 21 formed at the other end thereof to receive the reduced tube part 22 of another tent pole to be connected to the enlarged tube part 21. The enlarged tube part 21 is not essential since the reduced tube part 22 can be inserted into the tent pole without the enlarged tube part 21 if the external diameter of the reduced tube part 22 is smaller than or equal to the internal diameter of the tent pole 20.

Next, another preferred embodiment having the enlarged tube part 21 will be described. A reinforced rod 40 is provided inside a start part 23 of the reduced tube part 22 of the tent pole 20 to reinforce the start part 23. The reinforced rod 40 is in the form of a ring of a prescribed thickness and has an external form corresponding to an internal form of the start part 23 of the reduced tube part 22. The reinforced rod 40 is inserted into the tent pole 20 and located at the start part 23 of the reduced tube part 22.

When the reduced tube part 22 is formed at an end portion of the tent pole 20, the start part 23 of the reduced tube part 22 is slanted as shown in FIG. 6. Therefore, to reinforce the slanted start part 23, the reinforced rod 40 includes a tubular part 42 having a ring shape with an external diameter corresponding to the internal diameter of the reduced tube part 22 and a conical part 44 having a slant surface 43, which has an external diameter corresponding to, and is sized and shaped according to the slanted internal diameter of the start part 23.

The enlarged tube part 21 of the tent pole 20 is provided with a stopper 30 to restrict the advance of the reduced tube part 22 of the other tent pole when the tent poles are connected to each other.

When the reduced tube part 22 is inserted into the enlarged tube part 21 of the tent pole, if the end portion of the reduced tube part 22 directly contacts the inner surface of the enlarged tube part 21, the inside of the enlarged tube part 21 may be damaged. Also, if the end portion of the enlarged tube part 21 engages the start part 23 of the reduced tube part 22 or the end portion of the reduced tube part 22 engages the enlarged tube part, the connected tent poles may not be separated from each other. The stopper 30 mounted inside the enlarged tube part 21 avoids the above problems by preventing the reduced tube part 22 from being inserted beyond a prescribed limit. As shown in FIG. 7, it is preferable that the stopper 30 is in the form of a ring and has a hole 31 formed in the center thereof.

The tent poles 20 and 20' are connected to each other by the following structure. First, the stopper 30 and the reinforced rod 40 are inserted and fixed inside the enlarged tube part 21 and the reduced tube part 22 of the tent pole 20. The stopper 30 is inserted and fixed inside the enlarged tube part 21 of the other tent pole 20' having the same structure. As shown in FIG. 6, the reduced tube part 22 of the tent pole 20 is inserted into the enlarged tube part 21 of the other tent pole 20'. When the end portion of the reduced tube part 22 of the tent pole 20 is contacted to the stopper 30 inside the other tent pole 20', the movement of the reduced tube part 22 is topped, and thereby the connection between the tent poles 20 and 20' is finished.

As previously described, according to the present invention, the reinforced rod 40 is mounted inside the start part 23 of the reduced tube part 22 of the tent pole 20 to reinforce the start part 23. Therefore, even though stress is concentrated on the start part 23 by the external force, the start part is protected from the damage by the reinforcing action of the reinforced rod 40.

Moreover, since the strength of the start part 23 is increased by the reinforcing action of the reinforced rod 40, the length of the reduced tube part 22 inserted into the enlarged tube part 21 can be reduced, and thereby the weight of the tent pole can be reduced.

Since the stopper 30 mounted inside the enlarged part 21 restricts the depth of the reduced tube part, the inside of the enlarged tube part 21 or the outside of the start part of the reduced tube part can be prevented from damage due to excessive insertion of the reduced tube part 22. Furthermore, the stopper 30 prevents the end portion of the enlarged tube part from engaging the start part of the reduced tube part or the end portion of the reduced tube part from engaging the slant surface of the enlarged tube part, and thereby the connected tent poles can be separated easily.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A tent pole assembly comprising:

a first tent pole section having a reduced tube part of a prescribed length formed at an end, the reduced tube part being inserted into a second tent pole section; and a reinforced rod disposed inside a start part of the reduced tube part to reinforce the start part, the reinforced rod having an external form corresponding to an internal form of the start part.

2. The tent pole assembly as claimed in claim 1, wherein the reinforced rod includes a round portion in the form of a rung having an external diameter corresponding to an internal diameter of the reduced tube part, and including a conical portion having a slanted surface, the conical portion having an external diameter corresponding to a slanted internal diameter of the start part.

3. The tent pole as claimed in claim 1, further comprising an enlarged tube part formed in the second tent pole section to receive the reduced tube part of the first tent pole section, and a stopper disposed inside the enlarged tube part to restrict the advance of the reduced tube part.

4. The tent pole as claimed in claim 2, further comprising an enlarged tube part formed in the second tent pole section to receive the reduced tube part of the first tent pole section, and a stopper disposed inside the enlarged tube part to restrict the advance of the reduced tube part.

5. The tent pole as claimed in claim 3, wherein the stopper is in the form of a ring having a hole at the center.

6. The tent pole as claimed in claim 4, wherein the stopper is in the form of a ring having a hole at the center.

7. A method of connecting tent poles comprising the steps of:

mounting a reinforcing rod inside a start part of a reduced tube part of a prescribed length formed at an end portion of a first tent pole section, said reinforcing rod having an external form corresponding to an internal form of the start part; and connecting the first tent pole section with a second tent pole section by inserting the reduced tube part into an end portion of the second tent pole section.

8. The structure as claimed in claim 7, wherein an enlarged tube part is formed at the end portion of the second tent pole section to receive the reduced tube part of the first tent pole section and a stopper is disposed inside the enlarged tube part to restrict the advance of the reduced tube part.

* * * * *